US005676053A

United States Patent [19]

Schäfer

[11] Patent Number: 5,676,053

[45] Date of Patent: Oct. 14, 1997

[54] METHOD AND APPARATUS FOR INKING A WATERLESS PLANOGRAPHIC PRINTING PLATE

[75] Inventor: Karl Robert Schäfer, Rimpar, Germany

[73] Assignee: Koenig & Bauer Aktiengesellschaft, Wurzburg, Germany

[21] Appl. No.: 502,775

[22] Filed: Jul. 14, 1995

[30] Foreign Application Priority Data

Jul. 14, 1994 [DE] Germany ..... 44 24 891.1

[51] Int. Cl.[6] ..... B41F 7/24

[52] U.S. Cl. ..... 101/141; 101/148; 101/452

[58] Field of Search ..... 101/147, 148, 101/450.1, 451, 452, 350, 364, 366, 141

[56] References Cited

U.S. PATENT DOCUMENTS 4,724,764 2/1988 MacPhee et al. ..... 101/451

OTHER PUBLICATIONS

Toray Industries, Inc.; Toray Waterless Plate.

Deutscher Drucker; "Der Wasserlose Offsetdruck–Wechselwirkungen Zwischen Farbe und Druckform"; May 6, 1993; vol. #17.

*Primary Examiner*—J. Reed Fisher

*Attorney, Agent, or Firm*—Jones, Tullar & Cooper, P.C.

[57] ABSTRACT

A method and apparatus for inking a "waterless" planographic printing plate utilizes an ink application unit and a separating agent application unit. These two units supply conventional ink and a separating agent either directly or indirectly to the planographic printing plate.

8 Claims, 5 Drawing Sheets

METHOD AND APPARATUS FOR INKING A WATERLESS PLANOGRAPHIC PRINTING PLATE

FIELD OF THE INVENTION

The present invention is directed generally to a method and apparatus for inking a "waterless" planographic printing plate. More particularly, the present invention is directed to a method and apparatus for inking a "waterless" planographic printing plate of a rotary offset printing press. Most specifically, the present invention is directed to a method and apparatus for inking a "waterless" planographic printing plate of a rotary offset printing press having an inking unit which is associated with the planographic printing plate. The "waterless" planographic printing plate is inked by its associated inking unit which may use conventional printing inks or which may use inks particularly adapted for "waterless" printing plates. A separating agent application unit is provided separate from the inking unit and may be utilized to supply a separating agent directly or indirectly to the "waterless" planographic printing plate.

DESCRIPTION OF THE PRIOR ART

It is known generally to use so-called "waterless" printing plates in offset planographic printing. A description of a printing plate that is usable for this "waterless" planographic printing may be found in a publication entitled "Toray Waterless Plate" from Toray Industries, Inc. Such "waterless" planographic printing plates are also described in U.S. Pat. No. 3,511,178 to Curtin and in European Patent No. EP-0-113 925 A2 of Toray Industries, Inc.

These "waterless" planographic printing plates are divided into printing areas and non-printing areas. The non-printing areas have a strong affinity for conventional inks; i.e. for inks which are not specifically adapted for use with "waterless" printing plates. This strong affinity of the non-printing portions of these "waterless" planographic printing plates for conventional inks results in the covering of these non-printing areas with ink when the special "waterless" inks are not used. Once the non-printing areas of the "waterless" planographic printing plates become covered with ink, they transfer this ink to the sheet or web being printed. This, of course, results in unacceptable print quality. The press must be stopped and the plates must be removed and cleaned. The only way that "waterless" printing plates have been usable in the past is in conjunction with special inks which are adapted specifically for use with these "waterless" planographic printing plates. Such specially adapted "waterless" inks are more expensive than conventional inks and may not always perform as well.

It will thus be seen that there is a need for a method and apparatus that will allow conventional inks to be used with "waterless" planographic printing plates. The method and apparatus for inking "waterless" planographic printing plates in accordance with the present invention provides this result and is a significant improvement over the prior art.

SUMMARY OF THE INVENTION

It is an object of the present invention to provide a method and apparatus for inking a "waterless" planographic printing plate.

Another object of the present invention is to provide a method and apparatus for inking a "waterless" planographic printing plate of a rotary offset printing press.

A further object of the present invention is to provide a method and apparatus for inking a "waterless" planographic printing plate of a rotary printing press having an inking unit associated with the planographic printing plate.

Still another object of the present invention is to provide a method and apparatus for inking a "waterless" planographic printing plate using conventional inks which are not adapted to "waterless" planographic printing.

As will be set forth in detail in the description of the preferred embodiments which is presented subsequently, the method and apparatus for inking a "waterless" planographic printing plate in accordance with the present invention utilizes an inking unit which is in indirect contact with the planographic printing plate and a separating agent application unit which supplies a suitable separating agent, such as silicon oil, to the "waterless" planographic printing plate along a separate path. The separating agent application unit may be in either direct or indirect contact with the planographic printing plate. This separating agent application unit is separate from the ink application unit which can supply conventional ink to the "waterless" planographic printing plate.

A primary advantage of the present invention is that conventional inks can be used in the inking unit. This means that special "waterless" inks, which contain a separating agent, do not have to be used in the ink application unit. The problems involved in ink transfer because of the inclusion of separating agents in the ink-feeding roller train are eliminated by the present invention.

Another advantage of the present invention is that the amount of separating agent used can be more closely metered. Since the separating agent is being applied by a separating agent application unit, the quantity of separating agent applied, and the timing of the application can be controlled. The application of the separating agent can be adapted to various operational stages of a rotary offset printing press during the operation of the press.

The affinity of the waterless ink-repellant, non-printing areas of the "waterless" planographic printing plate for conventional ink is reduced by the application of the separating agent. These waterless ink-repellant, non-printing areas of the planographic printing plate are slightly raised above the level of the printing areas of the plate. Since these raised areas can be protected by a continuous supply of the separating agent, which is supplied in exactly metered amounts, these areas of the planographic printing plate are not subjected to as great an amount of wear as they otherwise would be. In addition, the provision of a separating agent application unit, in accordance with the present invention, facilitates the return of used, separating agent to the application unit. This accomplishes the cleaning of the planographic printing plates.

While the present invention facilitates the use of conventional printing inks with "waterless" planographic printing plates, it does not preclude the utilization of special waterless printing inks. It is possible to use these special inks, which are adapted to "waterless" planographic printing in the printing unit of the present invention.

The method and apparatus for inking a "waterless" planographic printing plate in accordance with the present invention overcomes the limitations of the prior art. It is a substantial advance in the art.

BRIEF DESCRIPTION OF THE DRAWINGS

While the novel features of the method and apparatus for inking a "waterless" planographic printing plate in accordance with the present invention are set forth with particularity in the appended claims, a full and complete understanding of the invention may be had by referring to the detailed description of the preferred embodiments, which is presented subsequently, and as illustrated in the accompanying drawings, in which:

DETAILED DESCRIPTION OF THE PREFERRED EMBODIMENTS

Figure 1:
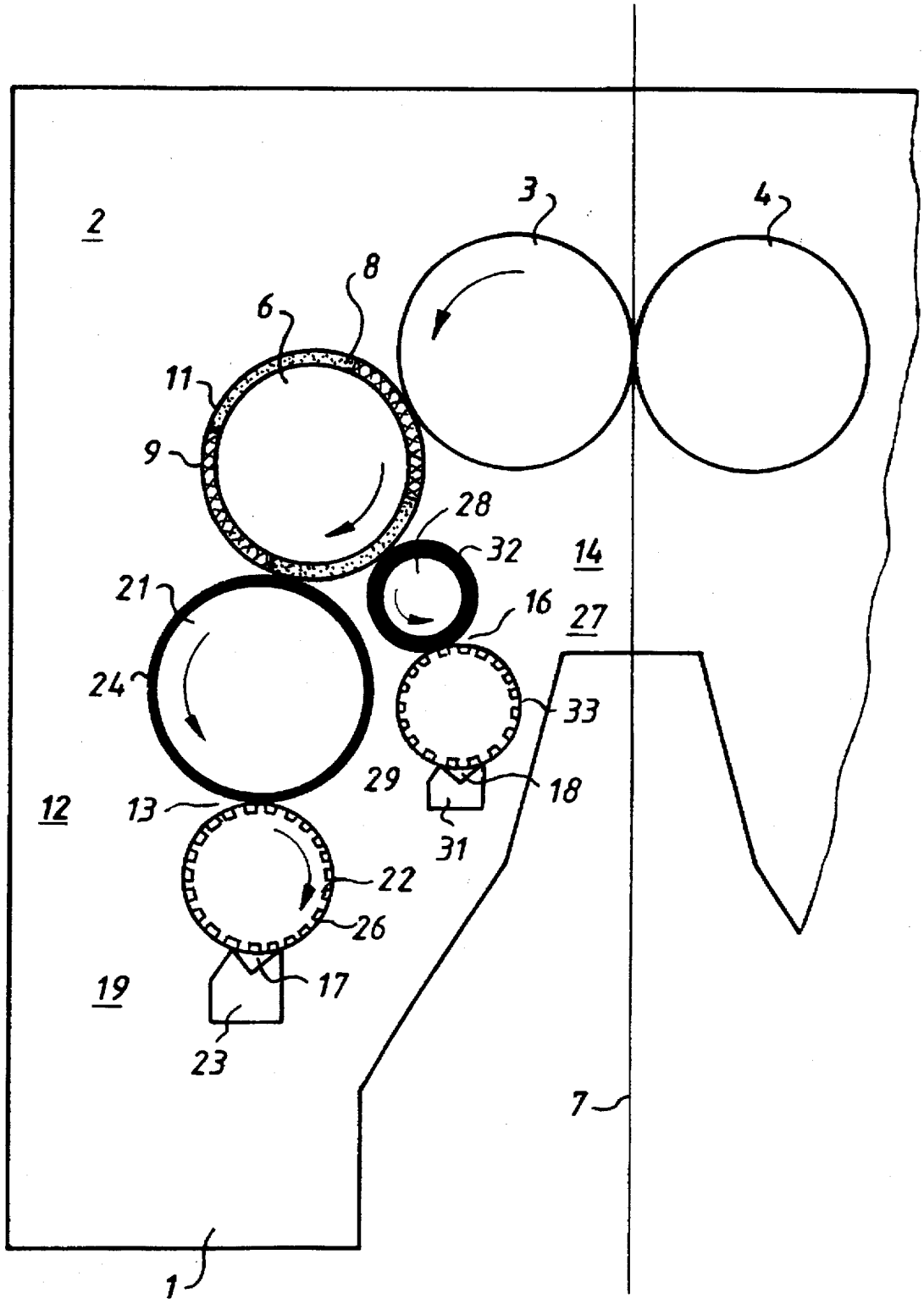
FIG. 1 is a schematic side elevation view of a first preferred embodiment of a printing unit in accordance with the present invention and having a short inking unit and a short separating agent application unit.

Referring initially to FIG. 1, there may be seen a first preferred embodiment of an offset printing unit, generally at 2, in accordance with the present invention. This offset printing unit 2 utilizes a rubber cylinder 3 as a blanket cylinder, and a similar rubber cylinder 4 as a counter-pressure cylinder. These two cylinders 3 and 4 cooperate to print a paper web 7 which passes between these two cylinders. An ink image to be applied to the paper web 7 by the blanket cylinder 2 is formed by a waterless planographic printing plate 8 that is secured to a plate cylinder 6. The planographic printing plate 8 is adapted to accomplish so-called "waterless" planographic printing. It is provided with ink-accepting printing areas 9 as well as with waterless ink-repellant, non-printing areas 11. These non-printing areas 11 are elevated slightly with respect to the level of the printing areas 9. These various cylinders, as well as the additional cylinders and rollers to be described subsequently, are all supported for rotation between laterally spaced side frames of the rotary offset printing press 2. Only one such side frame 1 is depicted in the drawings with the other side frame having been removed for clarity. It will also be understood that like reference numerals will be used to identify like elements in the several preferred embodiments of the present invention.

Referring again to FIG. 1, it may be seen that the rotary offset printing unit 2 in accordance with the first preferred embodiment of the present invention utilizes an ink application unit 12 that has an ink-conducting roller train 13, and a separating agent application unit 14 that has a separating agent-conducting roller train 16. These two application units 12 and 14 both cooperate with the "waterless" planographic printing plate 8 carried on the plate cylinder 6. A conventional printing ink 17; i.e. ink not specifically adapted for "waterless" planographic printing, is applied from the ink application unit 12, through its ink-conducting roller train 13 to the planographic printing plate 8. A separating agent 18, such as silicon oil, is supplied to the "waterless" planographic printing plate 8 by the separating agent application unit 14 through its separating agent-conducting roller train 16.

As may be seen in FIG. 1, in the first preferred embodiment, the ink application unit 12 is a short inking unit 19 that consists of a soft application roller 21 which contacts the planographic printing plate 8, a screen roller 22, and a doctor device 23. The doctor device 23 is preferably a chambered doctor blade and is the source of the conventional ink 17. These elements form the short inking unit 19 of the first preferred embodiment. The soft ink application roller 21 has a surface coating 24, and the screen roller 22 has a coating 26. Both of these coatings are ink-accepting.

In the first preferred embodiment of the present invention, the separating agent application unit 14 is embodied as a short application unit 27. This short application unit 27 has a soft separating agent application roller which is in contact with the "waterless" planographic printing plate 8, a screen roller 29, and a doctor device 31, which is preferably a chamber doctor blade. The doctor device 31 is the reservoir or source of the separating agent 18. The separating agent application roller 28 is provided with a soft coating 32 which is separating agent-accepting. This coating 32 may be a silicon caoutchouc or rubber, a fluorosilicon caoutchouc or rubber, or a silicon oxide.

In this first preferred embodiment of the apparatus for inking a "waterless" planographic printing plate in accordance with the present invention, conventional ink 17 and a separating agent 18, such as silicon oil, are applied by their respective screen rollers 22 and 29 from their respective doctor devices 23 and 31. The ink 17 is applied to the soft ink application roller 21 and the separating agent 18 is applied to the soft separating agent application roller 28 from the respective screen rollers 22 and 29. From the soft application rollers 21 and 28, the ink 17 and the separating agent 18 are applied to the "waterless" planographic printing plate 8. In this process, the non-printing areas 11 of plate 8 are wetted with the separating agent 18 while the printing areas 9 of the planographic printing plate 8 are wetted with the conventional printing ink 17. This method and apparatus thus allows a "waterless" planographic printing plate 8 to be used with conventional printing ink 17 by providing separate ink application and separating agent application units in the form of the short inking unit 19 and the short separating agent application unit 27.

Figure 2:
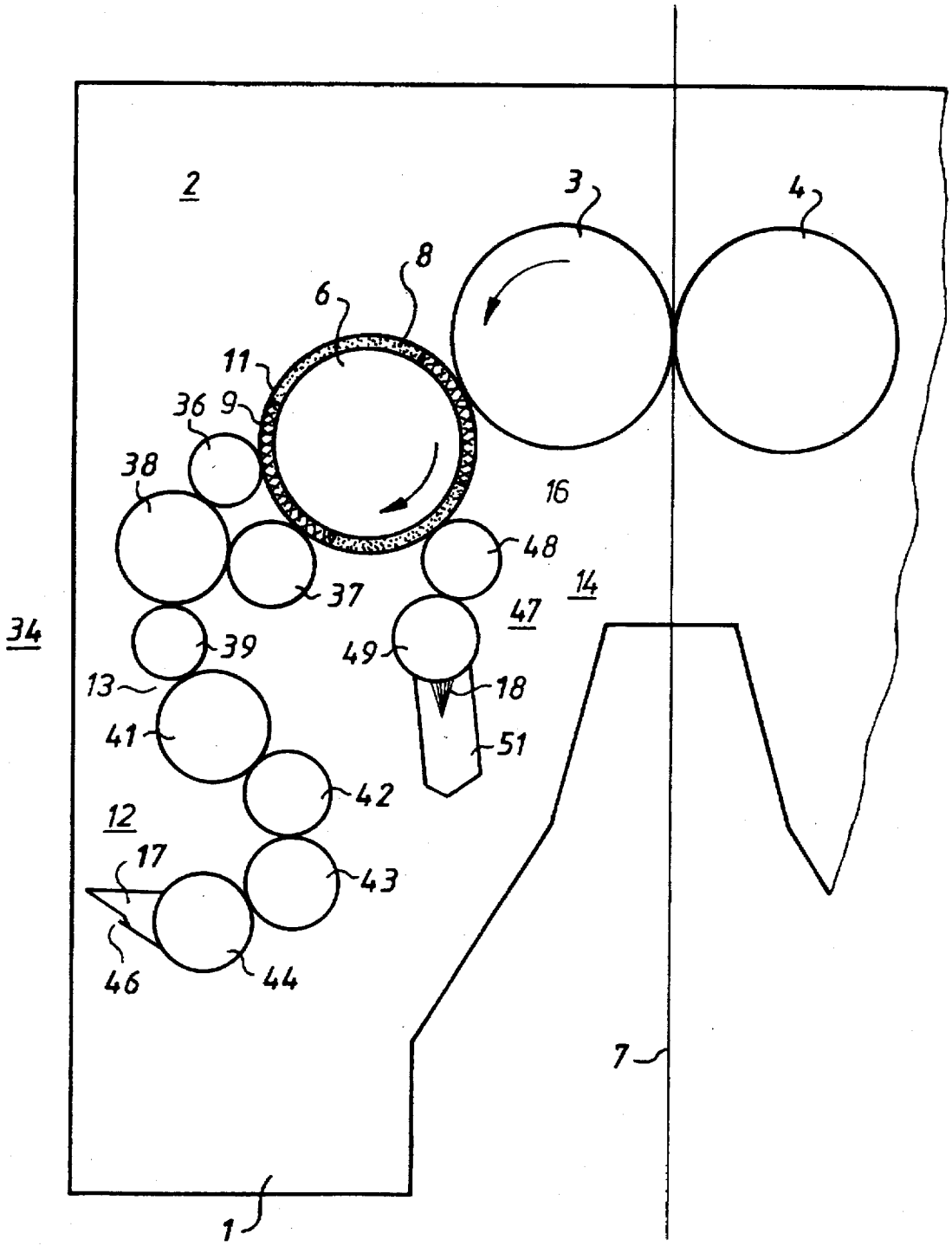
FIG. 2 is a schematic side elevation view of a second preferred embodiment and showing a printing unit with a conventional inking unit and with a spray application unit for the separating agent.

Turning now to FIG. 2, there may be seen a second preferred embodiment of an apparatus for inking a "waterless" planographic printing plate in accordance with the present invention. In this second preferred embodiment, the ink application unit, generally at 12, is provided in the form of a generally conventional inking unit 34 instead of the short inking unit 19 depicted in FIG. 1. In this second preferred embodiment, as seen in FIG. 2, the conventional inking unit 34 includes two ink application rollers 36 and 37 that are resting against the printing plate 8 on the plate cylinder 6. These two ink application roller 36 and 37 are in contact with a first ink distributing cylinder 38. The first ink distributing cylinder 38, together with a second ink distributing cylinder 39 and an ink film roller 43 are connected by two interposed ink transfer rollers 39 and 42. The first ink transfer roller 41 is in contact with the second ink distribution cylinder 39, and the second ink transfer roller 42 is in contact with the film roller 43, all as seen in FIG. 2. An ink ductor roller 44 supplies the ink film roller 43 with conventional printing ink 17 which is supplied to the ink ductor roller 44 from an ink duct 46. All of the rollers and cylinders in the inking unit 34; i.e. ink application rollers 36 and 37, ink distribution cylinders 38 and 39, ink transfer rollers 41 and 42, and ink film roller 43, as well as ink ductor roller 44 are provided with an ink-accepting coating which may be, for example caoutchouc or rubber, or Rilsan.

In this second preferred embodiment, the separating agent application unit 14 can be a spray application unit, as depicted at 47 in FIG. 2, instead of the short application unit depicted at 27 in FIG. 1. In this spray application unit 47 for the separating agent 18, the separating agent application roller 48 is in contact with the "waterless" planographic printing plate 8 on the plate cylinder 6. The separating agent application roller 48 receives separating agent 18 from a separating agent distributing roller 49. The separating agent 18 is applied to this distributing roller 49 by means of a spray unit 51 which is generally conventional in operation and is not described in detail. In this second embodiment, the spray unit 51 is the source of the separating agent 18.

Figure 3:
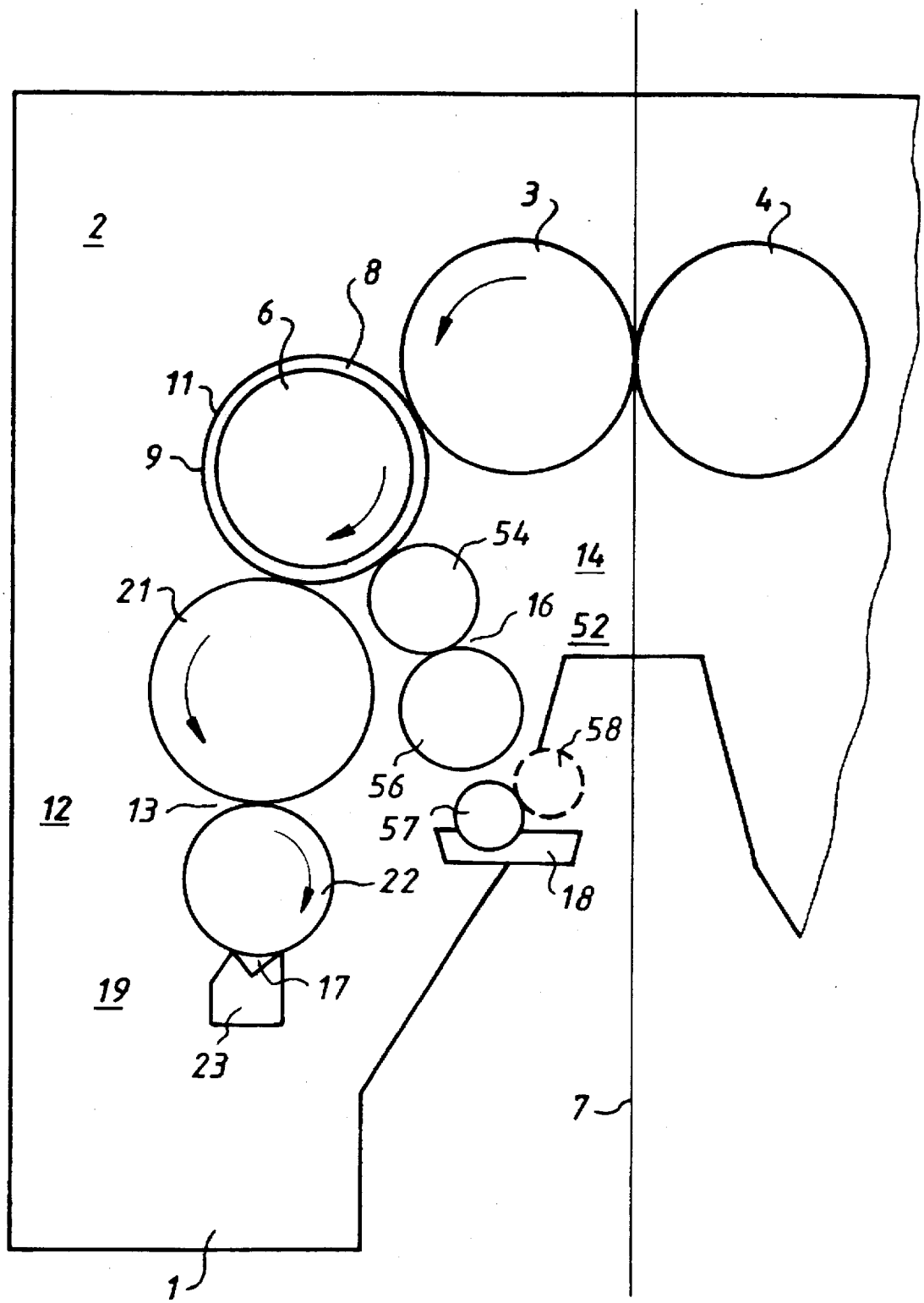
FIG. 3 is a schematic side elevation view of a third preferred embodiment of the present invention and showing a printing unit having a short inking unit and a brush application unit for the separating agent.
Figure 4:
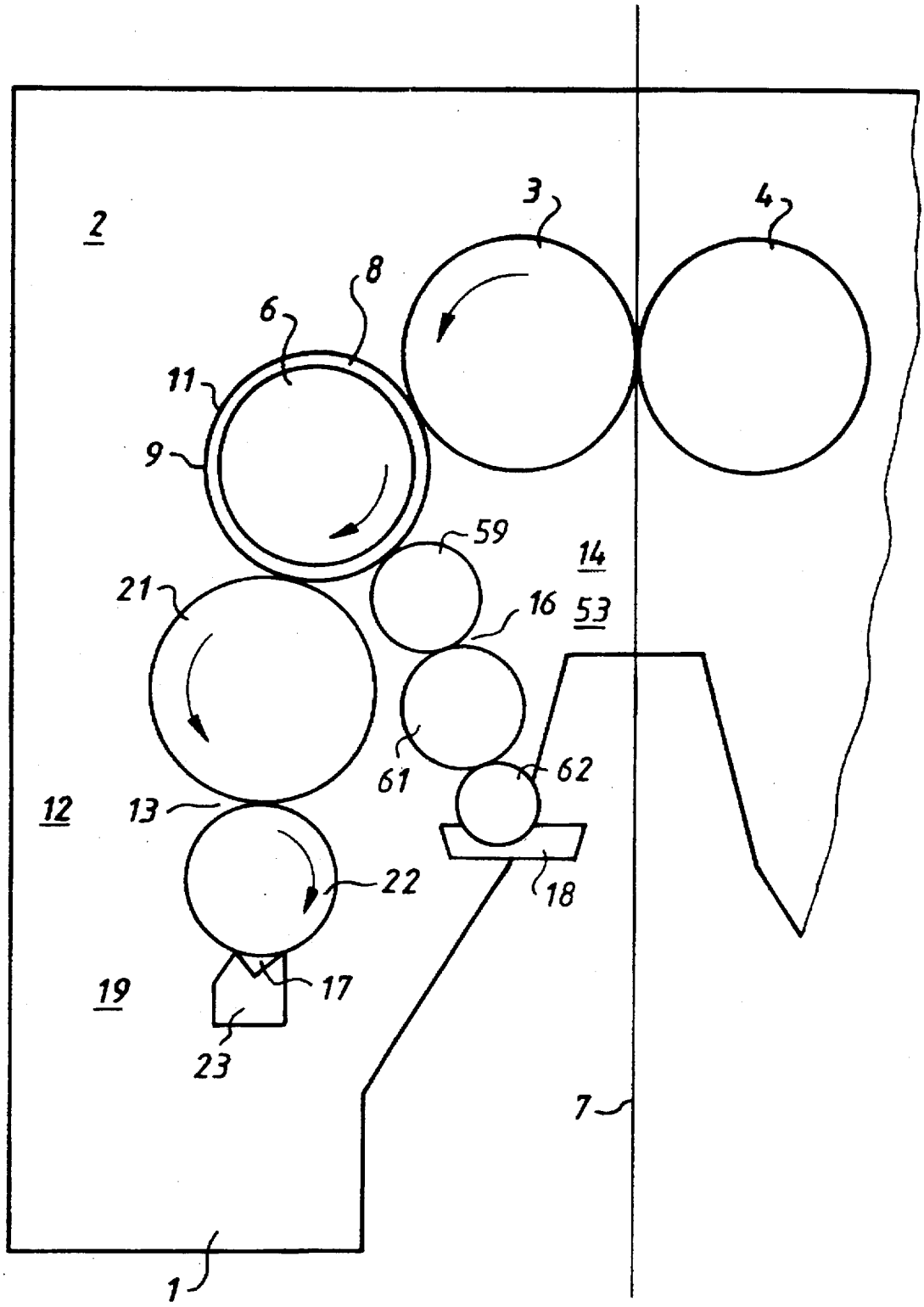
FIG. 4 is a schematic side elevation view of the present invention and showing a printing press having a short inking unit and a film dampening system for the separating agent.

In FIGS. 3 and 4 there are depicted third and fourth preferred embodiments, respectively of an apparatus for inking a "waterless" planographic printing plate in accordance with the present invention. In the third preferred embodiment depicted in FIG. 3, the separating agent application unit 14 is a brush application unit 52. In the fourth preferred embodiment, as shown in FIG. 4, the separating agent application unit 14 is a film application unit 53. In these third and fourth preferred embodiments, the ink application unit 12 is the short inking unit 19 which has previously been described in the first embodiment.

As may be seen in FIG. 3, the brush application unit 52 includes a separating agent application roller 54 which is in contact with the "waterless" planographic printing plate 8, and a separating agent distributing roller 56 that is in contact with the separating agent application roller 54. A separating agent ductor roller 57 receives the separating agent 18 from a reservoir and this separating agent 18 is transferred from the ductor roller 57 to the distributing roller 56 by a generally known brush roller 58.

As may be seen in FIG. 4, in the fourth preferred embodiment, which utilizes a film application unit 53, the separating agent application roller 59 is in contact with printing plate 8 on plate cylinder 6 and receives separating agent 18 from a separating agent distributing roller 61. A separating agent ductor roller 62 picks up the separating agent 18 from its reservoir. As was the case in the previously described embodiments, all of the rollers and cylinders in these several separating agent application units 14 have coatings which are separating agent accepting.

Figure 5:
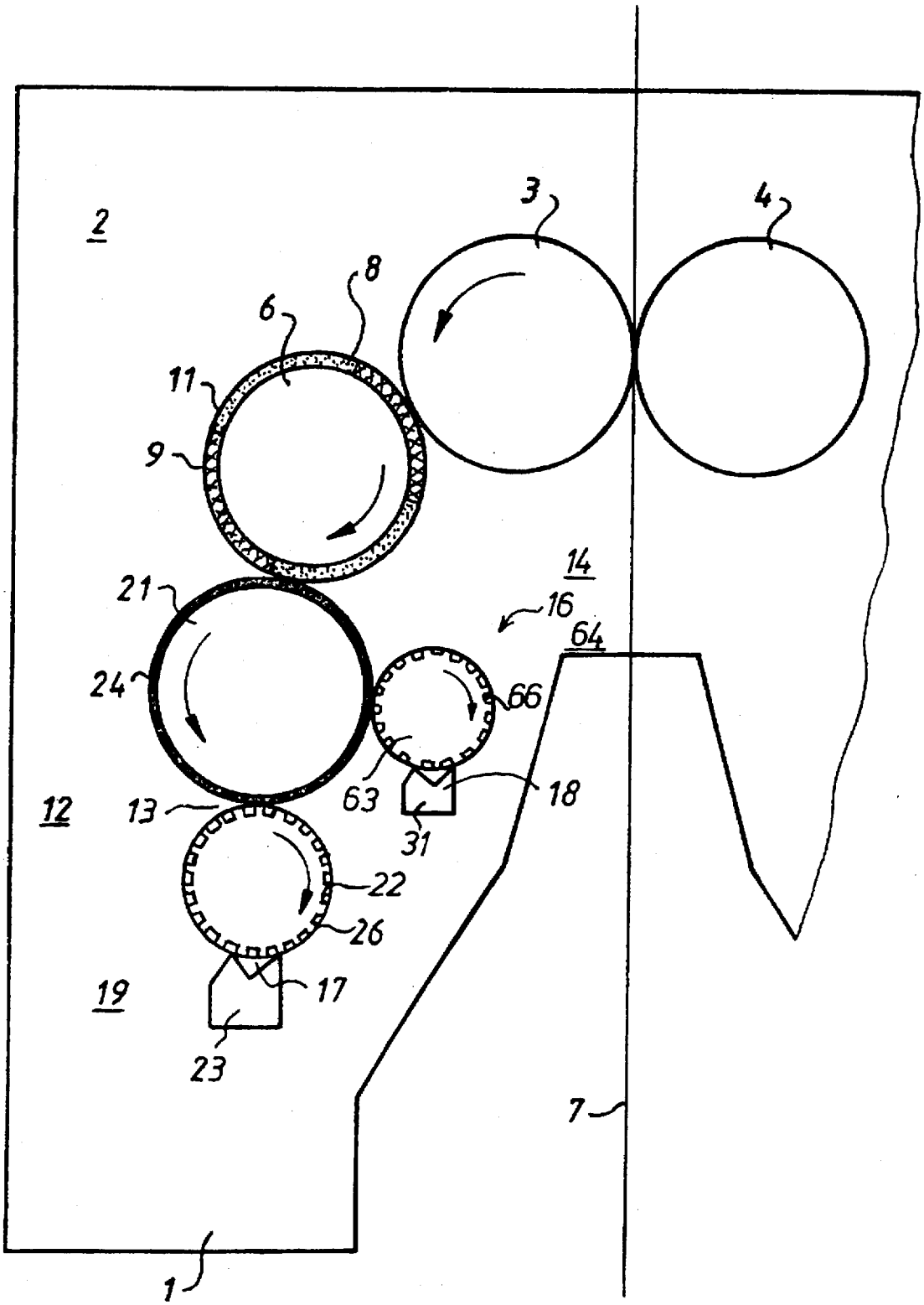
FIG. 5 is a schematic side elevation view of a fifth preferred embodiment of the present invention and showing a printing press with an indirect supply of the separating agent to the "waterless" planographic printing plate.

Turning now to FIG. 5, there may be seen a fifth preferred embodiment of an apparatus for inking a "waterless" planographic printing plate in accordance with the present invention. In this fifth preferred embodiment, the separating agent 18 is applied indirectly to the "waterless" planographic printing plate 8. As may be seen in FIG. 5, there is provided a short separating agent application unit, generally at 64, in which a separating agent application roller 63 of the unit 64 is in engagement with the soft ink application roller 21. This separating agent application roller 63 transfers separating agent 18 to the soft ink application roller 21 from a doctor device 31 similar to the doctor device described in connection with FIG. 1. The soft ink application roller 21 is thus provided with both ink 17 and separating agent 18 and transfers both of these to the "waterless" planographic printing plate 8. In this preferred embodiment, the separating agent 18 is indirectly supplied to the planographic printing plate 8 by the separating agent application roller 63 through the soft ink application roller 21. In this fifth preferred embodiment, the separating agent application roller 63 is provided with a hard, separating agent accepting coating 66, such as, for example silicon oxide. Additionally, this hard separating agent application roller 63 is embodied as a screen roller which cooperates with the doctor device 31.

In each of the above described separating agent application units 14, the coatings of the various rollers and cylinders are all separating agent accepting. If these coatings are soft, they may be of silicon or fluorosilicon caoutchouc or rubber. If these coatings are hard, they can be of silicon oxide, for example. The number of individual rollers in the separating agent application units can be variable. It will also be understood that the separating agent application roller for each of the separating agent application units can be made to be thrown off from or moved away from its associated plate cylinder or ink application roller. This will stop the supply of separating agent 18 to the "waterless" planographic printing plate 8 from the separating agent application unit 14. This may be desirable if an ink, which is adapted for use with "waterless" planographic printing plate 8 is being supplied to plate 8 from the ink application unit 12 and thus there is no need for the separate application of an additional separating agent 18.

While preferred embodiments of a method and apparatus for inking a "waterless" planographic printing plate in accordance with the present invention have been set forth fully and completely hereinabove, it will be apparent to one of skill in the art that a number of changes in, for example, the overall sizes of the various units, the drive assemblies for the units, the type of paper web being printed and the like could be made without departing from the true spirit and scope of the present invention which is accordingly to be limited only by the following claims.

What is claimed is:

1. A method for inking a waterless planographic printing plate including the steps of:

providing a waterless planographic printing plate having ink accepting printing areas and non-printing areas;

providing a plate cylinder and supporting said waterless planographic printing plate on said plate cylinder;

supplying ink to said ink accepting printing areas of said waterless planographic printing plate using an ink application unit;

providing a separating agent application unit including a separating agent application roller having a separating agent accepting coating;

supplying a separating agent to said non printing areas of said waterless planographic printing plate using said separating agent application unit; and operating said ink application unit and said separating agent application unit independently of each other.

2. The method of claim 1 further including the step of using silicon oil as said separating agent applied to said waterless planographic plate cylinder by said separating agent application unit.

3. A device for inking a waterless planographic printing plate of a rotary offset printing press comprising:

a waterless planographic printing plate having ink accepting printing areas and non-printing areas;

a printing plate cylinder supporting said waterless planographic printing plate;

an inking unit associated with said printing plate cylinder, said inking unit supplying a printing ink to said ink accepting areas of said waterless planographic printing plate;

a separating agent application unit associated with said plate cylinder and including at least one separating agent application roller having a separating agent accepting coating and a separating agent source, said separating agent application unit being operable independently of said inking unit; and a separating agent conducting roller train supplying said separating agent to said non-printing areas of said waterless planographic printing plate.

4. The device of claim 3 wherein said separating unit application roller and said separating agent conducting roller train have rollers with a separating agent-accepting coating.

5. The device in accordance with claim 4 wherein said coating is selected from the group comprising silicon caoutchouc, fluorosilicon caoutchouc, and silicon oxide.

6. The device in accordance with claim 3 wherein said separating agent application unit is a short application unit having at least said one separating agent application roller, one screen roller and a separating agent doctor device.

7. The device in accordance with claim 3 wherein said separating agent application unit is a spray application unit having at least said one separating agent application roller, at least one separating agent distributing cylinder and a separating agent spray unit.

8. The device in accordance with claim 3 wherein said separating agent application unit is a brush application unit having at least said one separating agent application roller, at least one separating agent distributing cylinder, a separating agent ductor roller and a brush roller, said brush roller transferring said separating agent from said ductor roller to said distributing cylinder.

* * * * *